US007537428B2

(12) United States Patent
Hutchinson et al.

(10) Patent No.: US 7,537,428 B2
(45) Date of Patent: May 26, 2009

(54) ADJUSTABLY PIVOTABLE GRAPPLE WITH FIXED HEEL

(75) Inventors: Matthew S. Hutchinson, Pella, IA (US); Curt T. Graham, Lynnville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 213 days.

(21) Appl. No.: 11/566,739

(22) Filed: Dec. 5, 2006

(65) Prior Publication Data

US 2008/0129066 A1 Jun. 5, 2008

(51) Int. Cl.
*B66C 1/00* (2006.01)

(52) U.S. Cl. ..... 414/729; 294/106; 144/336

(58) Field of Classification Search ..... 414/735, 414/729, 739, 699; 294/88, 106; 144/336
See application file for complete search history.

(56) References Cited

U.S. PATENT DOCUMENTS

| | | | | |
|---|---|---|---|---|
| 2,757,037 | A | 7/1956 | Troyer | |
| 3,003,653 | A | 10/1961 | Wirkkala | |
| 3,501,035 | A * | 3/1970 | Whiting | 414/731 |
| 3,630,390 | A | 12/1971 | Cervenak | |
| 4,005,894 | A * | 2/1977 | Tucek | 414/731 |
| 4,140,233 | A | 2/1979 | Muntjanoff | |
| 4,486,136 | A | 12/1984 | Howard | |
| 5,575,093 | A * | 11/1996 | Pratt et al. | 37/468 |
| 5,607,251 | A * | 3/1997 | Rafn | 403/348 |
| 5,865,492 | A | 2/1999 | Horton | |
| 6,457,761 | B1 | 10/2002 | Benoit | |
| 6,551,051 | B2 | 4/2003 | Perron | |
| 6,655,899 | B1 | 12/2003 | Emerson | |
| 6,921,241 | B2 | 7/2005 | Rogers | |
| 2003/0031547 | A1 * | 2/2003 | Stumvoll et al. | 414/723 |
| 2004/0223838 | A1 | 11/2004 | Daniel | |

* cited by examiner

*Primary Examiner*—Donald Underwood
(74) *Attorney, Agent, or Firm*—Sturm & Fix LLP

(57) ABSTRACT

A grapple apparatus of a type having arms that pivot about parallel axes of a frame for grasping and releasing objects and wherein the entire grapple, including the grapple arms, pivots about a pivotal axis transverse to such parallel axes, and more particularly to a grapple which is pivotally adjustable about such pivotal axis between a first position and can be locked in at least the first and second positions thereof. A heel is fixed to the frame for supporting an object being grasped by the grapple when the grapple is in the first pivotal position thereof. A tooth is also optionally attached to the frame for permitting manipulation of the position of an object when the grapple itself is not being used.

15 Claims, 14 Drawing Sheets

ADJUSTABLY PIVOTABLE GRAPPLE WITH FIXED HEEL

CROSS REFERENCE TO RELATED APPLICATIONS

None.

BACKGROUND OF THE INVENTION

1. Field of the Invention

The present invention relates to a grapple of a type having arms that pivot about parallel axes of a frame for grasping and releasing objects and wherein the entire grapple, including the grapple arms, pivots about a pivotal axis transverse to such parallel axes, and more particularly to a grapple which is pivotally adjustable about such pivotal axis between a first position and can be locked in at least the first and second positions thereof. A heel is fixed to the frame for supporting an object being grasped by the grapple when the grapple is in the first pivotal position thereof.

2. Description of Related Art

Grapples with heels are well known, for example in U.S. Pat. No. 2,757,037 to Troyer, which is incorporated herein by reference, U.S. Pat. No. 4,486,136 to Howard and U.S. Pat. No. 6,551,051 to Perron et al. The known configuration, as disclosed in Troyer, Howard and Perron et al., includes a grapple, with two grapple arms that move about a common grapple arm pivot shaft. The grapple arm pivot shaft is supported in a structure that is mounted to a frame at a grapple pivot. A heel is also mounted to the frame. The grapple arm pivot shaft is able to freely move relative to the frame and the heel, due to freedom of motion provided by the grapple pivot. There are times when using this structure that the operator may want to control the orientation of the grapple with respect to the heel, for example to grasp a log with the grapple and then orient the log to a position wherein it will swing upwardly against the heel so that the heel prevents the end of the log adjacent the heel from pivoting upwardly with respect to the grapple. This is exceedingly difficult with the aforementioned prior art grapples which have no way to lock the grapple to prevent it from pivoting about the grapple arm pivot shaft.

Of course there are other times when it is desirable to orient the grapple in a predetermined pivotal position for any number of reasons, such as to use a prime mover having a grapple attached thereto to carry a log through a narrow gate; or, alternatively, to orient the log ninety degrees from such narrow gate orientation so that the center of gravity of the log is as close to the prime mover as possible.

There are other times when it may be desires to permit the grapple to freely pivot about a substantially vertical axis, so the preferred embodiment of the present invention can be used in that mode as well.

Accordingly there is a need for a grapple apparatus to overcome these aforementioned problems with prior art devices.

SUMMARY OF THE INVENTION

The present invention relates to a grapple of a type having arms that pivot about parallel axes of a frame for grasping and releasing objects and wherein the entire grapple, including the grapple arms, pivots about a pivotal axis transverse to such parallel axes, and more particularly to a grapple which is pivotally adjustable about such pivotal axis between a first position and can be locked in at least the first and second positions thereof. In some preferred embodiments a heel is fixed to the frame for supporting an object being grasped by the grapple when the grapple is in the first pivotal position thereof. In other preferred embodiments a tooth is also optionally attached to the frame for permitting manipulation of the position of an object when the grapple itself is not being used.

BRIEF DESCRIPTION OF THE DRAWINGS

The present invention will be more fully understood from the detailed description below when viewed in conjunction with the accompanying drawings in which.

DETAILED DESCRIPTION OF THE INVENTION

Figure 1:
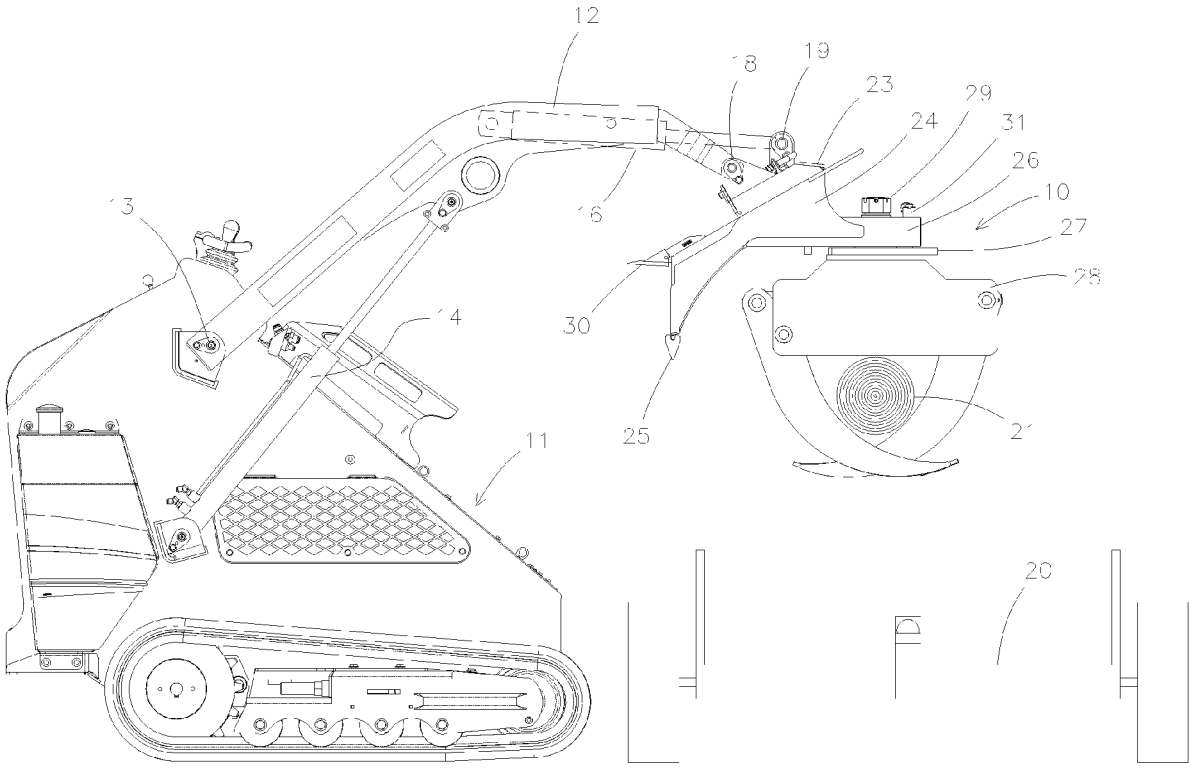
FIG. 1 is a side elevational view of the present invention mounted on a compact tool carrier and is show grasping and elevating a log above a trailer.

Referring now to the drawings wherein like reference numerals designate identical or corresponding parts throughout the several views, FIG. 1 shows a device 10 constructed in accordance with a preferred embodiment of the present invention, attached to a compact tool carrier 11 (This prime mover is often referred to as a "skid loader" when a front end loader bucket is attached to the front thereof) and is being used to lift a log 21 to or from a trailer 20.

Figure 10:
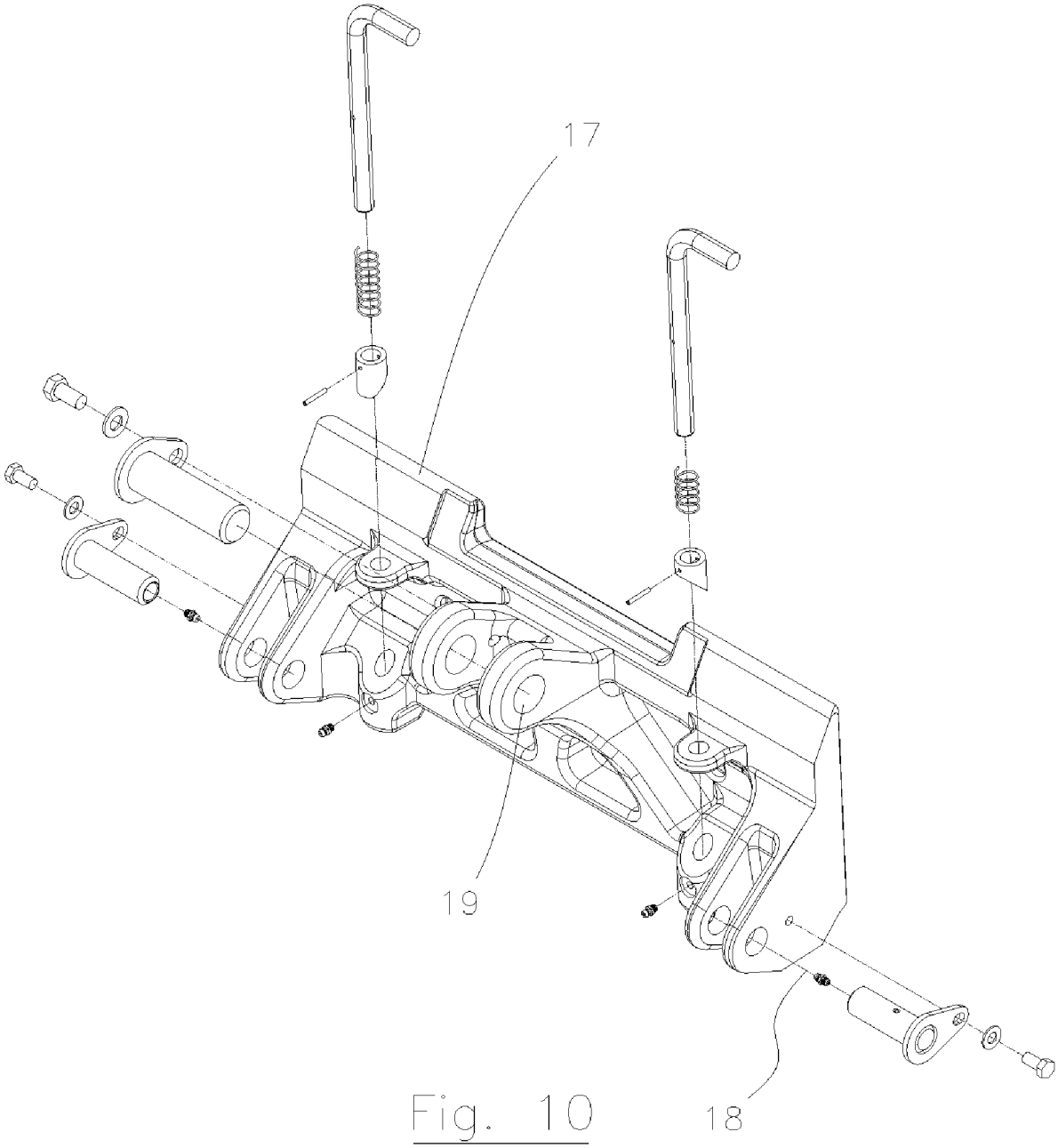
FIG. 10 is and exploded perspective view of a universal connector plate that attaches a boom of a compact tool carrier an adapter plate of the grapple to form a quick connection coupler.

The grapple apparatus 10 is pivotally attached to the boom 12, which boom 12 is pivotally attached to the compact tool carrier 11 at pivot 13. A hydraulic cylinder 14 pivotally attached at one end to the compact tool carrier 11 and pivotally attached to the boom 12 pivots the boom 12 up and down as desired. A universal mounting plate or adaptor 17, as best shown in FIG. 10, is pivotally connected to the boom 12 at pivot axis 18.

A hydraulic cylinder 16 is pivotally attached to the boom 12 at one end and is pivotally attached to the universal mounting plate 17 at the opposite end, at pivot axis 19. The grapple apparatus 10 includes an adapter plate or receiver 23 which mounts securely to the universal mounting plate 17 of the compact tool carrier 11 (FIG. 10). This allows the operator to pivot the grapple apparatus 10 between the positions of it shown in FIGS. 1 and 4, for example.

The adapter plate 23 is rigidly attached to a housing 24, which is, in turn rigidly attached to a frame 26. A grapple sub-frame comprises members 27 and 28 which are rigidly attached together. A grapple pivot pin 29 extends through member 27 and through frame 26 for pivotally attaching the sub-frame 27/28 to frame 26. So pin 29 can be referred to as a grapple pivot pin 29.

Figure 4:
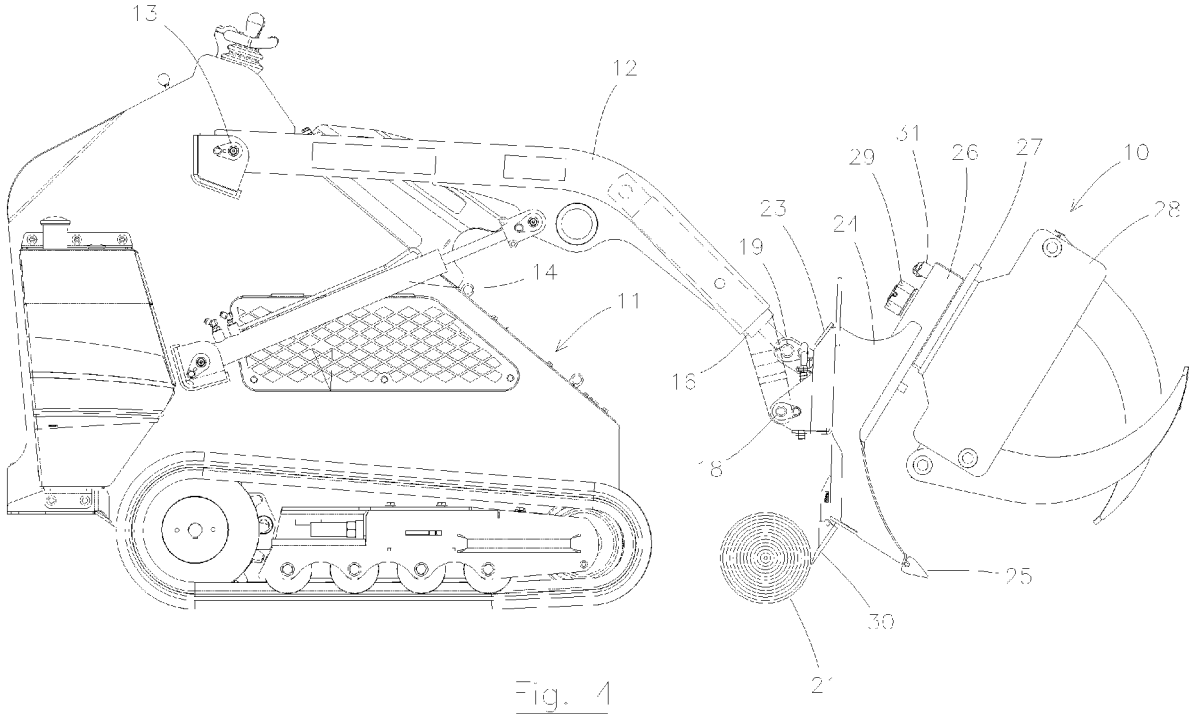
FIG. 4 is a side elevational view of the present invention attached to the compact tool carrier of FIG. 1, but showing how the grapple frame has a tooth on it which can be used to move or reorient an object such as the log shown by placing the tooth against the log and them moving the compact tool carrier, for example rearwardly, while the tooth is in engagement with the log.
Figure 5:
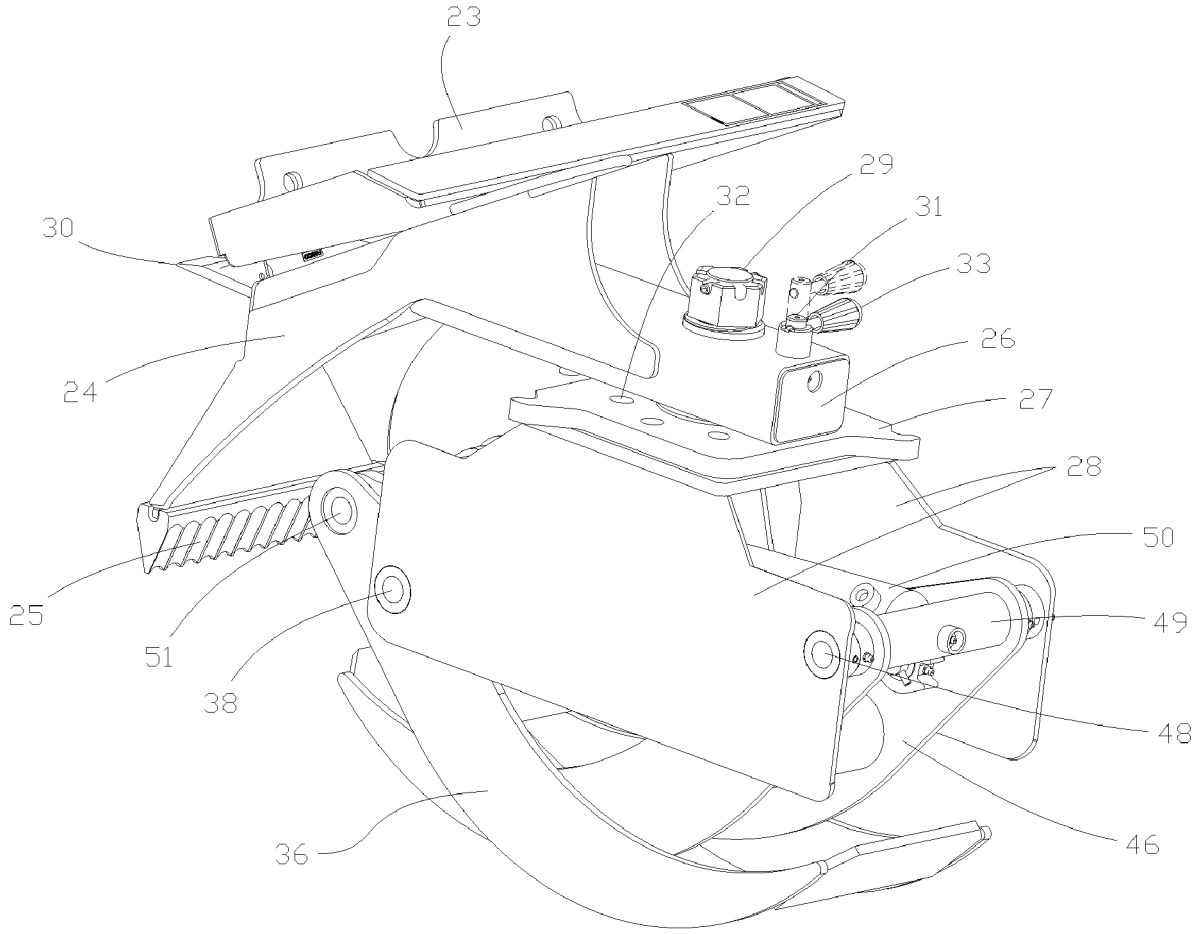
FIG. 5 is a perspective view of the grapple apparatus of the present invention with the grapple arms closed and a sub-frame of the grapple in the pivotal position shown in FIG. 1.
Figure 6:
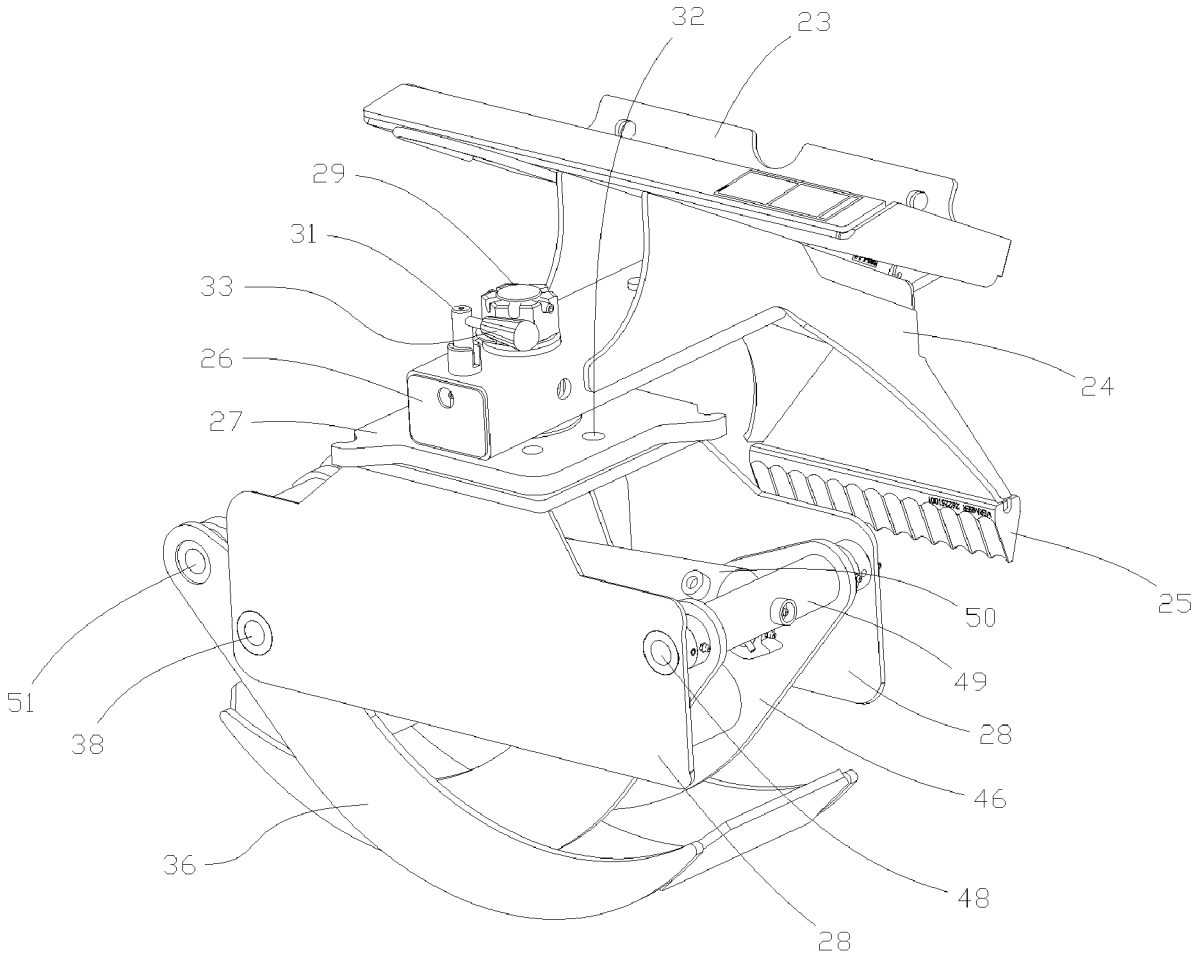
FIG. 6 is another a perspective view of the grapple apparatus of the present invention with the grapple arms closed and a sub-frame of the grapple in the pivotal position shown in FIG. 3.

Looking to FIG. 5 it is noted that the member 27 has a plurality of holes 32 therein for selectively receiving a pin 31 that has a handle 33 thereon for selectively locking the pin 31 in place or allowing the pin 31 to be moved upwardly to the position shown in dashed lines in FIG. 5 out of one of the openings 32. See also FIGS. 7 and 13 and a more detailed description below for the operation of the pin 31. This permits first pivoting the sub-frame 27/28 to the position desired and then locking the sub-frame 27/28 in such fixed position with respect to the frame 26 for example in the position shown in FIGS. 1, 2, 4 and 5 or alternatively in the position shown in FIGS. 3, 6 7 and 8. Of course the sub-frame 27/28 can be locked in positions between these two positions just mentioned in the sentence above this one, by placing the pin 29 in one of the other intermediate holes 32 in plate 27 after the sub-frame 27/28 is manually pivoted to the position desired.

Figure 7:
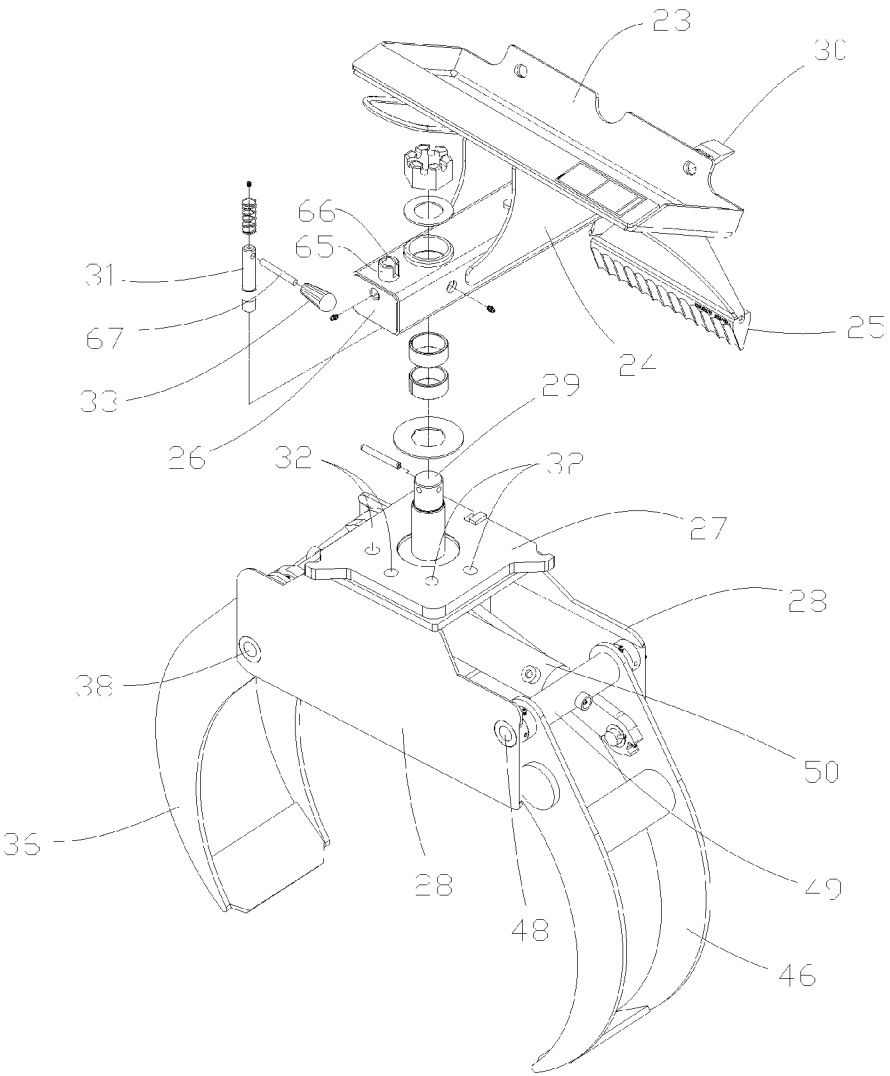
FIG. 7 is an exploded perspective in the orientation of FIG. 6, but with the grapple arms open.
Figure 8:
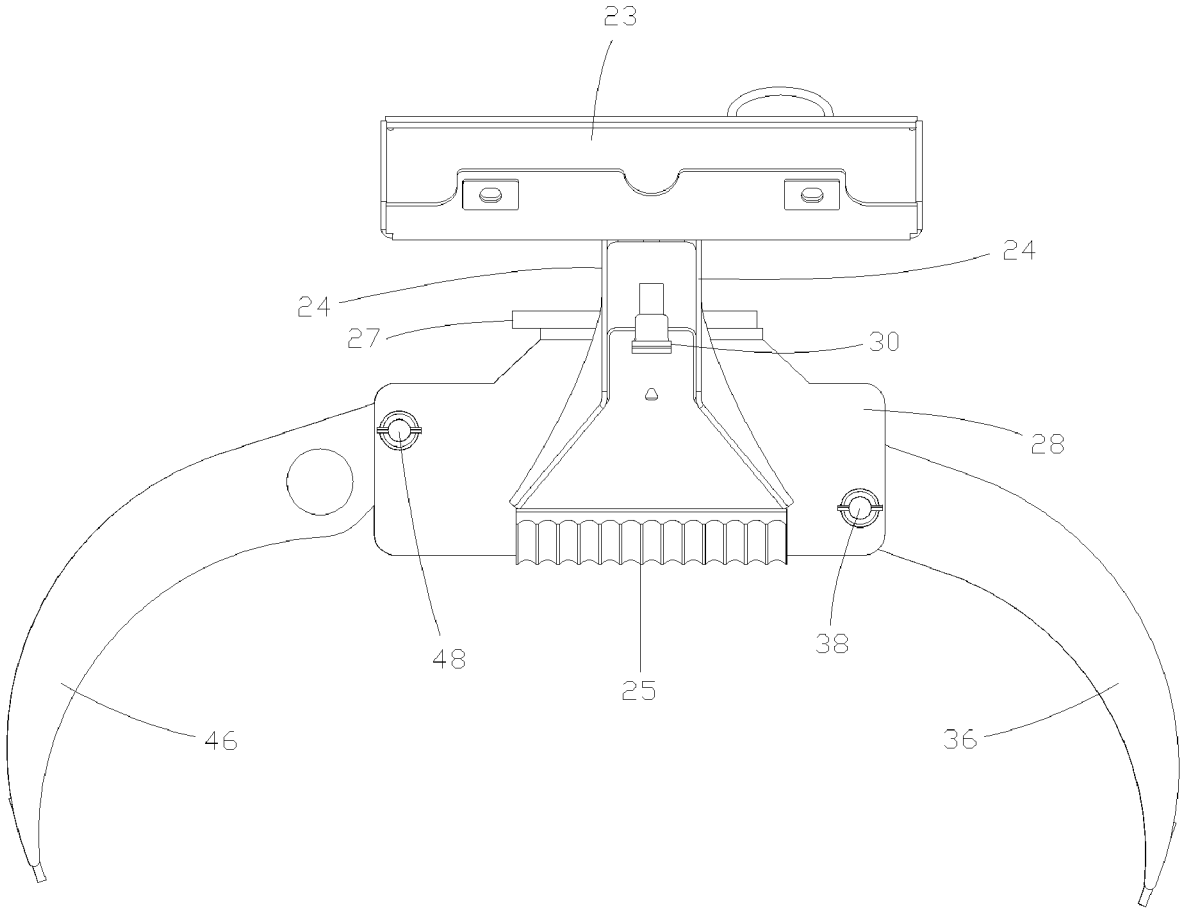
FIG. 8 is a side elevational view of the grapple apparatus with the grapple arms open but from the back side from the way it is shown in FIG. 6.
Figure 9:
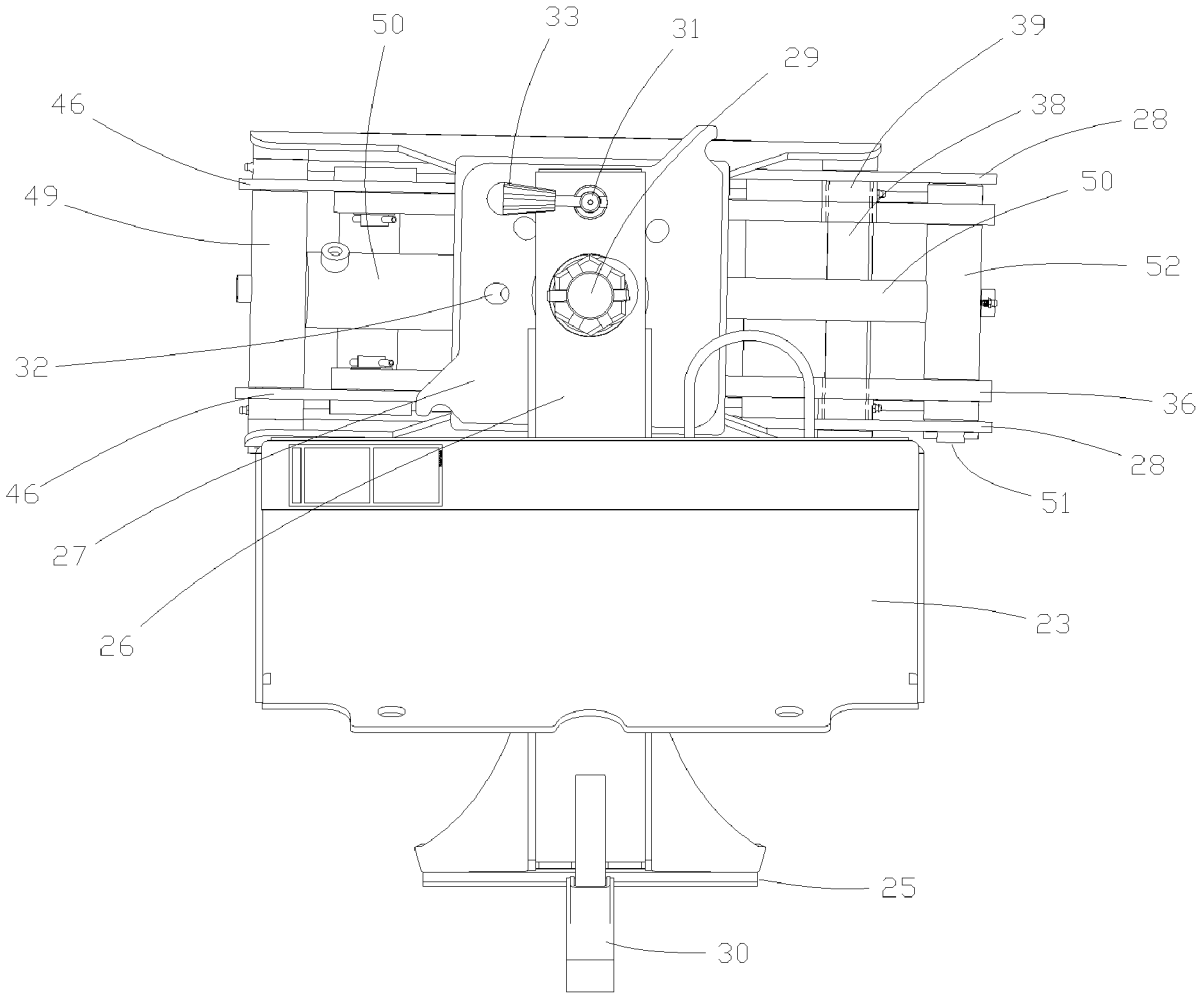
FIG. 9 is a top plan view of the grapple apparatus of the present invention.

Looking to FIGS. 5 and 9, for example, a first grapple member 36 is pivotally attached to the members 28 using a pin 38 inside a spacer 39. Similarly, a second grapple member 46 is pivotally attached to the members 28 using a pin 48 inside a spacer 49. A hydraulic cylinder 50 is pivotally operatively attached to a pin 51 on the first grapple 36 and to the spacer 49 around pin 48 of the second grapple 46. Of course lengthening the hydraulic cylinder 50 causes the first and second grapple members 36 and 46 to close as shown in FIGS. 1-6 and shortening the hydraulic cylinder 50 causes the first and second grapple members 36 and 46 to open to the position as shown in FIGS. 7 and 8.

Figure 2:
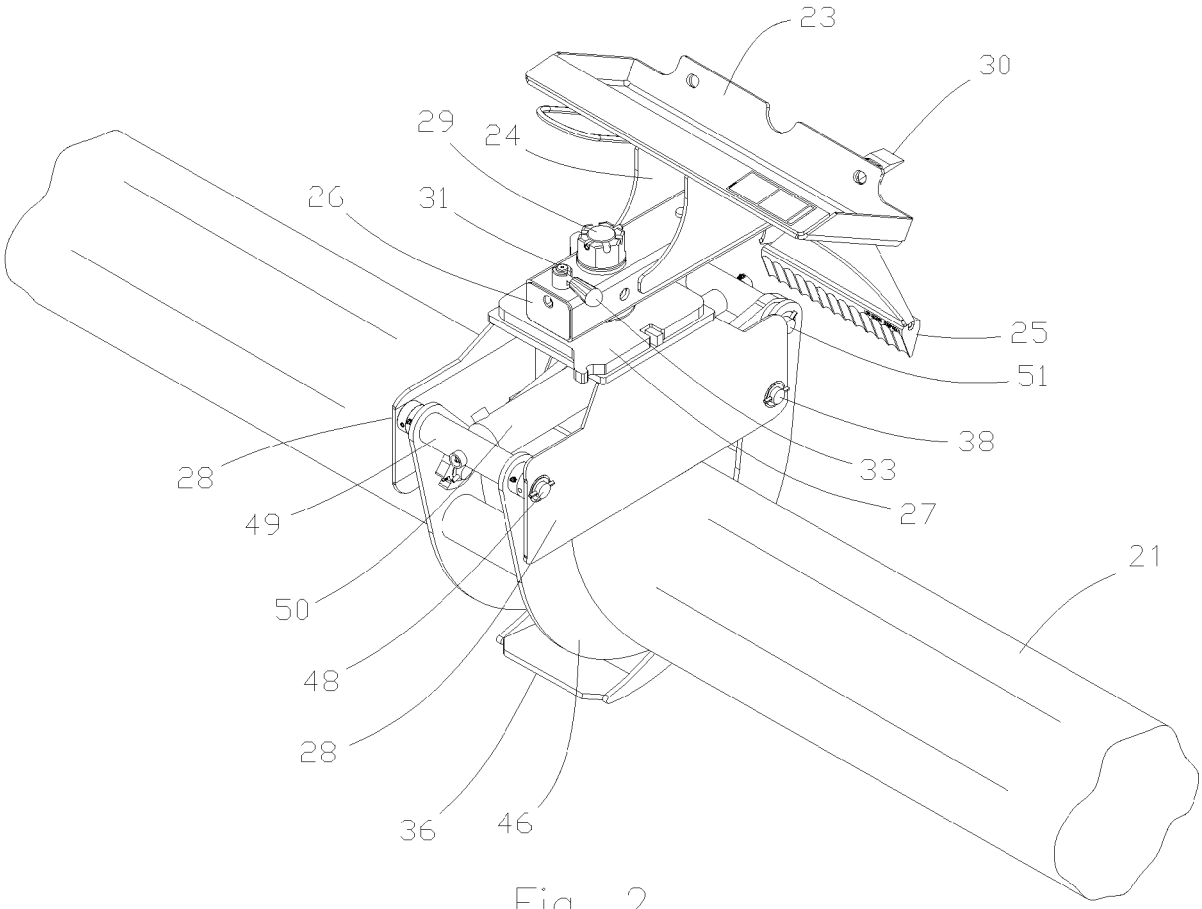
FIG. 2 is a perspective view of the grapple holding a log similar to the orientation shown in FIG. 1.

In operation, the grapple apparatus 10 of the present invention can be used to grasp an object such as the log 21 in the orientation shown in FIGS. 1 and 2 by first pivoting the sub-frame 27/28 to the position shown in FIGS. 1 and 2, then opening the grapple arms 36 and 46 by using cylinder 50. Then the compact tool carrier 11 and hydraulic cylinders 14 and 16 are used to move the grapple apparatus to a position over the log 21. When the grapple arms 36 and 46 are resting on top of the log 21, then hydraulic cylinder 50 is lengthened to cause the grapple arms 36 and 46 to close around the log 21 as shown in FIG. 1. Operating the present invention in this way permits the loads, such as the log 21, to be across the front of the skid loader or other prime mover, which allows the operator to lift heavier loads by keeping the load closer to the center of gravity of the machine. It is also useful for grabbing brush out of a pile of brush.

Figure 3:
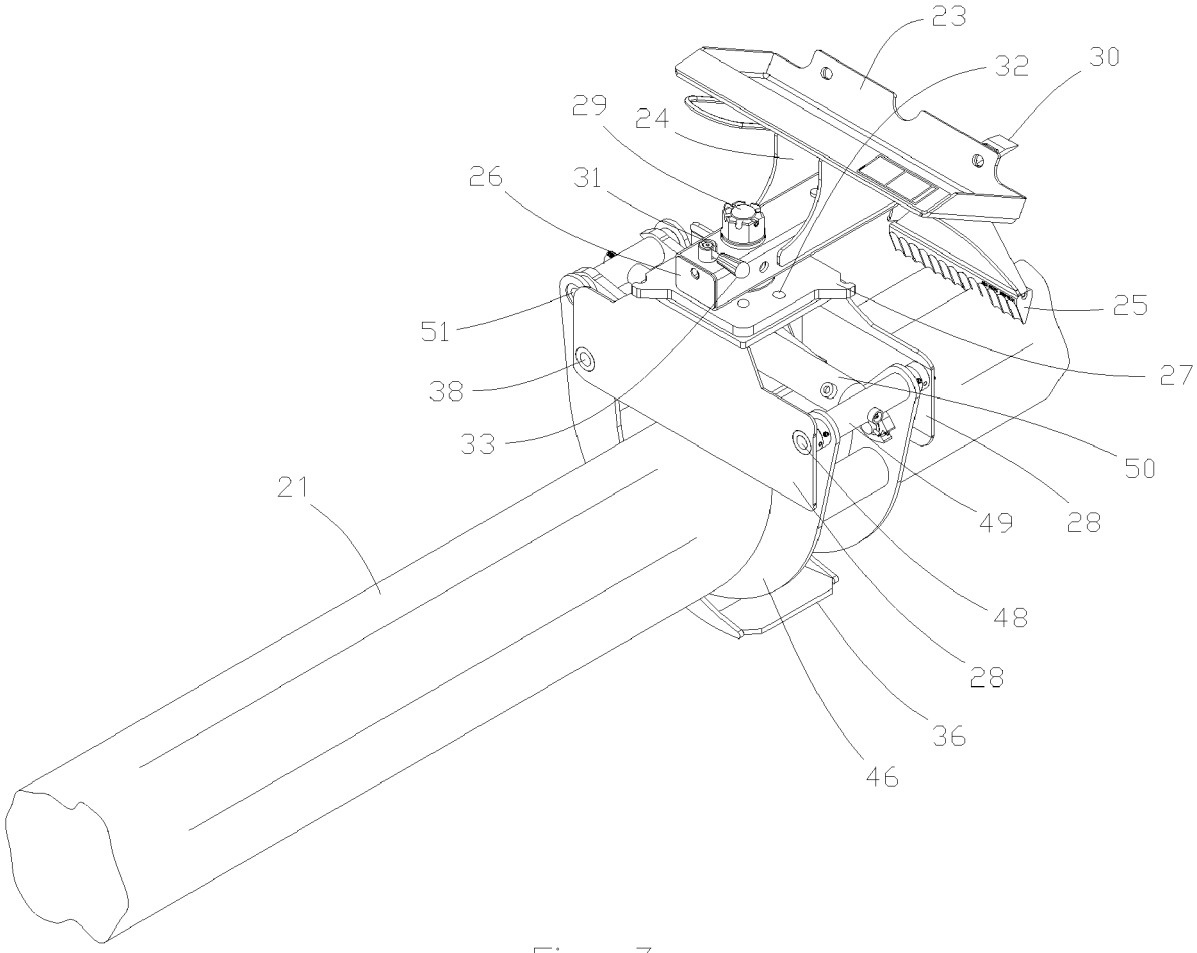
FIG. 3 is a perspective view in an orientation that is ninety degrees from the orientation of the log shown in FIG. 1 and showing how a heel helps to support the log by preventing the end of the log closest to the skid loader from pivoting upwardly.

Also in operation, the grapple apparatus 10 of the present invention can be used to grasp an object, such as the log 21, in the orientation shown in FIGS. 3 and 6-8 by first pivoting the sub-frame 27/28 to the position shown in FIGS. 3 and 6-8, then opening the grapple arms 36 and 46 by using hydraulic cylinder 50. Then the compact tool carrier 11 and hydraulic cylinders 14 and 16 are used to move the grapple apparatus to a position over the log 21. When the grapple arms 36 and 46 are resting on top of the log 21, the hydraulic cylinder 50 is lengthened to cause the grapple arms 36 and 46 to close around the log 21 as shown in FIG. 3. After that, when the grapple device 10 is raised, the end of the log closest to the compact tool carrier 11 will pivot upwardly into contact with the heel 25, thereby stabilizing the log 21 or other object being grasped. Operating the present invention in this way, by locking the grapple sub-frame 27/28 to the frame 24, permits the loads to be in-line with the machine. This allows a person to move long objects through gates without lifting the load high in the air. It also rigidly secures the load between the grapple arms 36/46 and the heel 25, so that the load, such as log 21, does not shift during transport.

FIG. 4 shows how the present invention is used to move an object, such as a log 21. The frame 28 has a tooth 30 rigidly attached to it, which tooth 30, used in conjunction with the compact tool carrier 11 and its hydraulic cylinders 14 and 16 can be used to move or reorient an object such as the log 21 shown by placing the tooth 30 against the log 21 and them moving the skid loader, for example rearwardly as shown in FIG. 4, while the tooth 30 is in engagement with the log 21.

Figure 11:
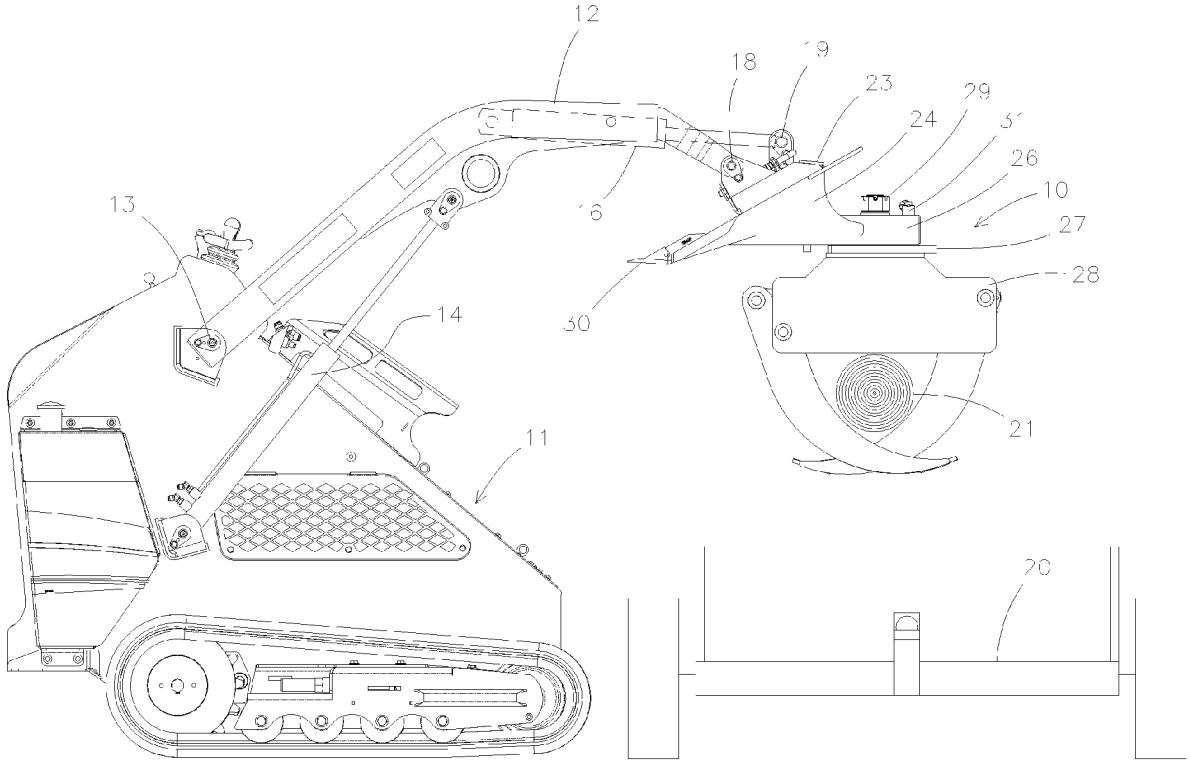
FIG. 11 is a view like FIG. 1 but with an alternate embodiment that does not have a heel on it.
Figure 12:
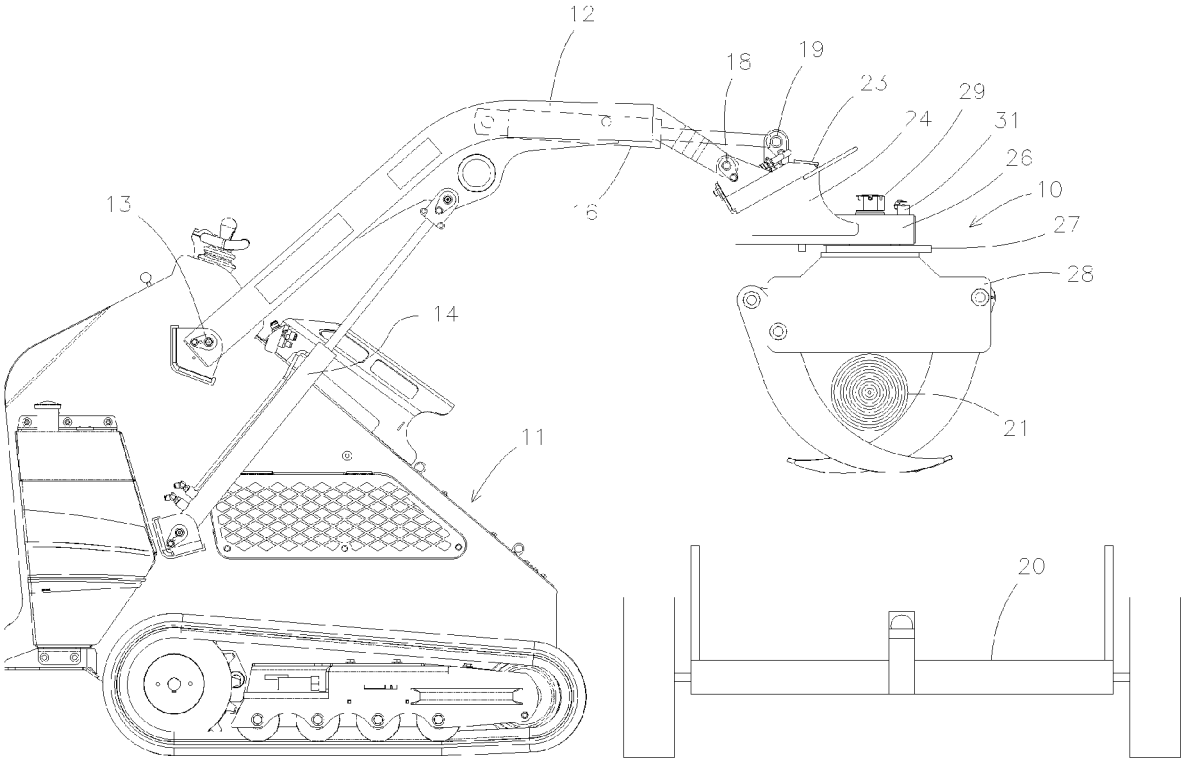
FIG. 12 is a view like FIG. 1 but with an alternate embodiment that does not have a heel or a tooth on it.
Figure 14:
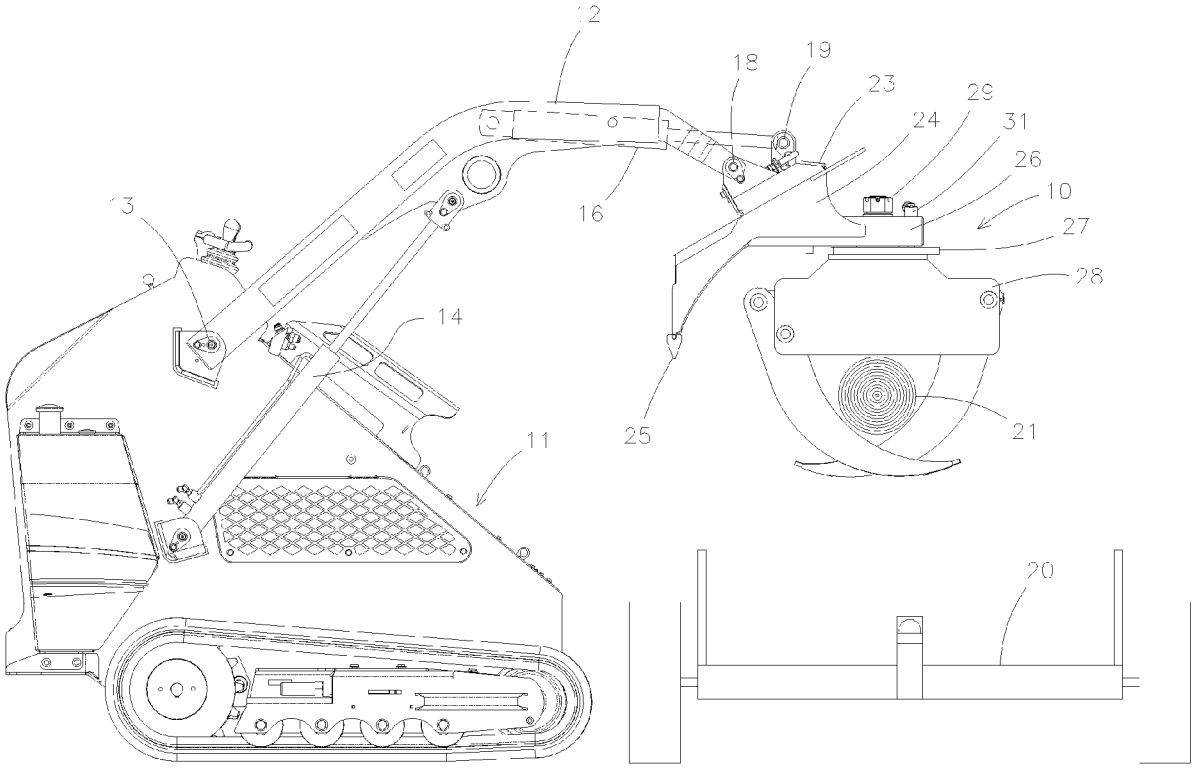
FIG. 14 is a view like FIG. 1 but with an alternate embodiment that has a heel but not a tooth on it.

FIG. 11 is a view like FIG. 1 but shows an alternate embodiment that does not have a heel on it like that shown in FIGS. 1-10. FIG. 12 is a view like FIG. 1 but with another alternate embodiment that does not have a heel or a tooth on it like that shown in FIGS. 1-11. FIG. 14 is a view like FIG. 1 but with an alternate embodiment that has a heel but not a tooth on it.

Figure 13:
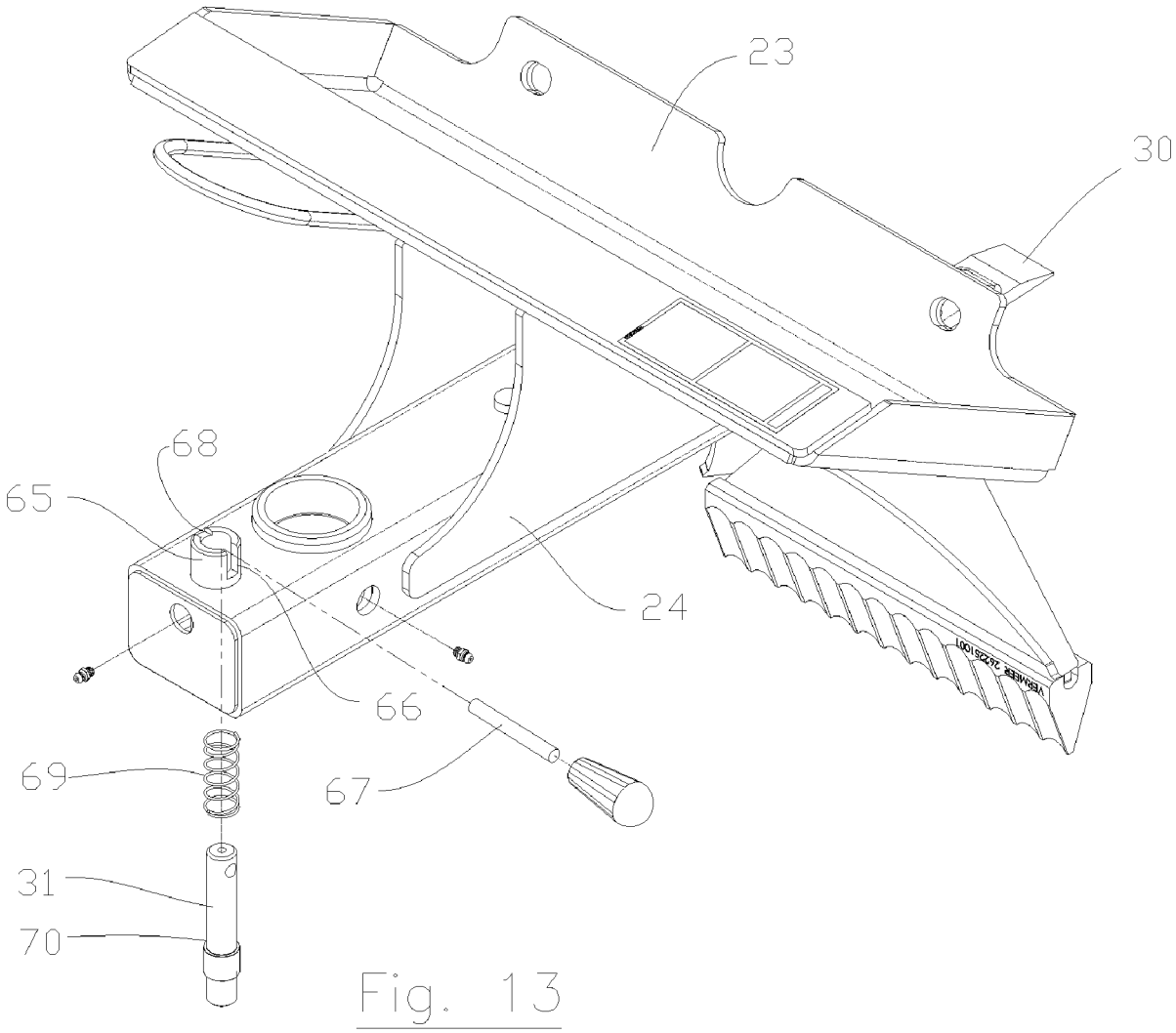
FIG. 13 is an exploded perspective view of the frame showing how a pin 31 is biased downwardly, how it can move downwardly if pivoted to one position and how it is held up when not in such one position.

FIGS. 7 and 13 show how the pin 31 is biased, by a compression spring 69, downwardly towards sub-frame 27/28 and into the slot 66 therein when the shaft 67 with handle 33 is aligned with the slot 66. When the shaft 67 is in the long slot 66 the pin can extend into any one of the holes 32 in member 27, thereby preventing the sub-frame 27/28 and the grapple arms 36 and 37 from pivoting about the axis of pin 29. This allows the grapple sub-frame 27/28 to be moved, for example, between the positions shown in FIGS. 2 and 3 and locked into the FIG. 2 or FIG. 3 positions for use as shown in FIGS. 2 and 3.

FIG. 13 shows a close-up of the lock pin 31, and supporting tube 65, with a long slot 66 and a short slot 68 with the spring 69 positioned between the bottom of tube 65 and a shoulder 70 on pin 31. FIGS. 7 and 13 also illustrate that when the shaft 67 is not in the slot 66 is in the short slot 68, the pin 31 is held above and out of the holes 32 because shaft 67 rests on the top shoulder of tube 65 at the top of short slot 68. When the pin 31 is held in this position, the sub-frame 27/28 and the sub-frame 27/28 and grapple arms 36 and 46 can freely pivot about the axis of pin 29. Some operators may prefer to use the grapple in this freely pivoting mode at certain times.

Accordingly, it will be appreciated that the preferred embodiments do indeed overcome the deficiencies of the prior art explained above. Obviously many modifications and variations of the present invention are possible in light of the above teachings. It is therefore to be understood that, within the scope of the appended claims, the invention may be practiced otherwise than as specifically described.

The invention claimed is:

1. An apparatus comprising:

a boom operatively pivotally attached to a prime mover about a first axis;

a frame operatively pivotally attached to the boom about a second axis;

a sub-frame operatively rotatably attached to the frame about a third axis, said sub-frame having a first rotational position with respect to the frame and a second rotational position approximately ninety degrees from the first rotational position;

a locking mechanism for selectively locking the sub-frame in at least the first rotational position thereof;

a first grapple arm operatively pivotally attached to the sub-frame about a fourth axis and being moveable between an open first grapple arm position and a closed first grapple arm position;

a second grapple arm operatively pivotally attached to the sub-frame about an axis coincident with or parallel to the fourth axis, the second grapple arm being moveable between an open second grapple arm position and a closed second grapple arm position; and a member operatively rigidly attached to the frame, the member being spaced from the third axis in a direction towards the prime mover, the member extending in a downwardly direction from the frame when the sub-frame is in the first position thereof wherein the member is a heel for contacting and helping balance an elongated object being held by the first and second grapple arms when the first and second grapple arms are closed; and a tooth operatively attached to the frame, said tooth extending from the frame in a direction transverse to the direction that the heel extends from the frame.

2. The apparatus of claim 1 wherein the locking mechanism is adjustable to selectively hold the sub-frame in the second rotational position thereof with respect to the frame.

3. The apparatus of claim 1 including a hydraulic cylinder operatively attached to the first grapple arm for selectively moving the first grapple arm between the open first grapple arm position and the closed first grapple arm position.

4. The apparatus of claim 3 wherein the hydraulic cylinder is also operatively attached to the second grapple arm for selectively moving the second grapple arm between the open second grapple arm position and the closed second grapple arm position.

5. The apparatus of claim 1 wherein the sub-frame and first and second grapple arms are free to pivot about the second axis when the locking mechanism is in the unlocked position.

6. Apparatus comprising:

a boom operatively pivotally attached to a prime mover about a first axis;

a frame operatively pivotally attached to the boom about a second axis;

a sub-frame operatively rotatably attached to the frame about a third axis, said sub-frame having a first rotational position with respect to the frame and a second rotational position approximately ninety degrees from the first rotational position;

a locking mechanism for selectively locking the sub-frame in at least the first rotational position thereof;

a first grapple arm operatively pivotally attached to the sub-frame about a fourth axis and being moveable between an open first grapple arm position and a closed first grapple arm position;

a second grapple arm operatively pivotally attached to the sub-frame about an axis coincident with or parallel to the fourth axis, the second grapple arm being moveable between an open second grapple arm position and a closed second grapple arm position;

a heel operatively rigidly attached to the frame, the heel being spaced from the third axis in a direction towards the prime mover and when the first and second grapple arms are closed and holding an elongated object, the heel extending in a downwardly direction from the frame for contacting and helping to balance such elongated object being held by the first and second grapple arms; and a tooth operatively attached to the frame, said tooth extending from the frame in a direction transverse to the direction that the heel extends from the frame.

7. The apparatus of claim 6 wherein the locking mechanism is adjustable to selectively hold the sub-frame in the second rotational position thereof with respect to the frame.

8. The apparatus of claim 6 including a hydraulic cylinder operatively attached to the first grapple arm for selectively moving the first grapple arm between the open first grapple arm position and the closed first grapple arm position.

9. The apparatus of claim 8 wherein the hydraulic cylinder is also operatively attached to the second grapple arm for selectively moving the second grapple arm between the open second grapple arm position and the closed second grapple arm position.

10. The apparatus of claim 1 wherein the third axis is fixed with respect to the sub-frame.

11. The apparatus of claim 10 wherein the tooth is fixed with respect to the sub-frame.

12. The apparatus of claim 1 wherein a universal receiver is operatively attached to the boom and adapted to selectively receive and be rigidly attached to a universal adaptor member, the universal adaptor member being adapted to be operatively pivotally attached to the boom.

13. The apparatus of claim 6 wherein the third axis is fixed with respect to the sub-frame.

14. The apparatus of claim 13 wherein the tooth is fixed with respect to the sub-frame.

15. The apparatus of claim 6 wherein a universal receiver is operatively attached to the boom and adapted to selectively receive and be rigidly attached to a universal adaptor member, the universal adaptor member being adapted to be operatively pivotally attached to the boom.

* * * * *